US006412467B1

(12) United States Patent
Leimer

(10) Patent No.: US 6,412,467 B1
(45) Date of Patent: Jul. 2, 2002

(54) VALVE SEAL ASSEMBLY MODULE WITH SPRING AND RETAINERS

(75) Inventor: Mark A. Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/841,457

(22) Filed: Apr. 24, 2001

(51) Int. Cl.[7] ..... F02N 3/00
(52) U.S. Cl. ..... 123/188.6; 277/502
(58) Field of Search ..... 277/502; 123/188.6

(56) References Cited

U.S. PATENT DOCUMENTS

| | | | | |
|---|---|---|---|---|
| 1,157,196 | A | 10/1915 | Philp | |
| 1,344,347 | A | 6/1920 | Lee | |
| 1,370,346 | A | 3/1921 | Nelson | |
| 1,481,562 | A | 1/1924 | Rowe | |
| 3,069,175 | A | 12/1962 | Skinner | 277/48 |
| 3,498,621 | A | 3/1970 | Wilson | 277/152 |
| 3,601,420 | A | 8/1971 | Binford | 277/212 C |
| 5,072,950 | A | 12/1991 | Littleproud et al. | 277/9.5 |
| 5,558,056 | A | 9/1996 | Sakata | 123/188.6 |

*Primary Examiner*—Noah P. Kamen
(74) *Attorney, Agent, or Firm*—Rader, Fishman & Grauer PLLC

(57) ABSTRACT

The present invention is a valve stem seal assembly module for installation over a valve guide of an internal combustion engine. The module includes a seal retainer and an elastomeric annular seal circumferentially and frictionally contained within the retainer. The retainer is defined by an elongate cylindrical body having an annular flange at its lower end and at least one radially inwardly extending first boss at its upper end. A separate annular spring retainer has a lower radially outwardly extending second boss that interlockingly engages the first boss of the seal retainer, and an upper radially outwardly extending flange; a valve return spring extends longitudinally between and engages respective flanges of spring and seal retainers. The spring is effective to provide resilient engagement of first and second bosses prior to assembly, whereby the spring and seal retainers are telescopingly interconnected to facilitate installation of the module in a pre-assembly mode.

10 Claims, 1 Drawing Sheet

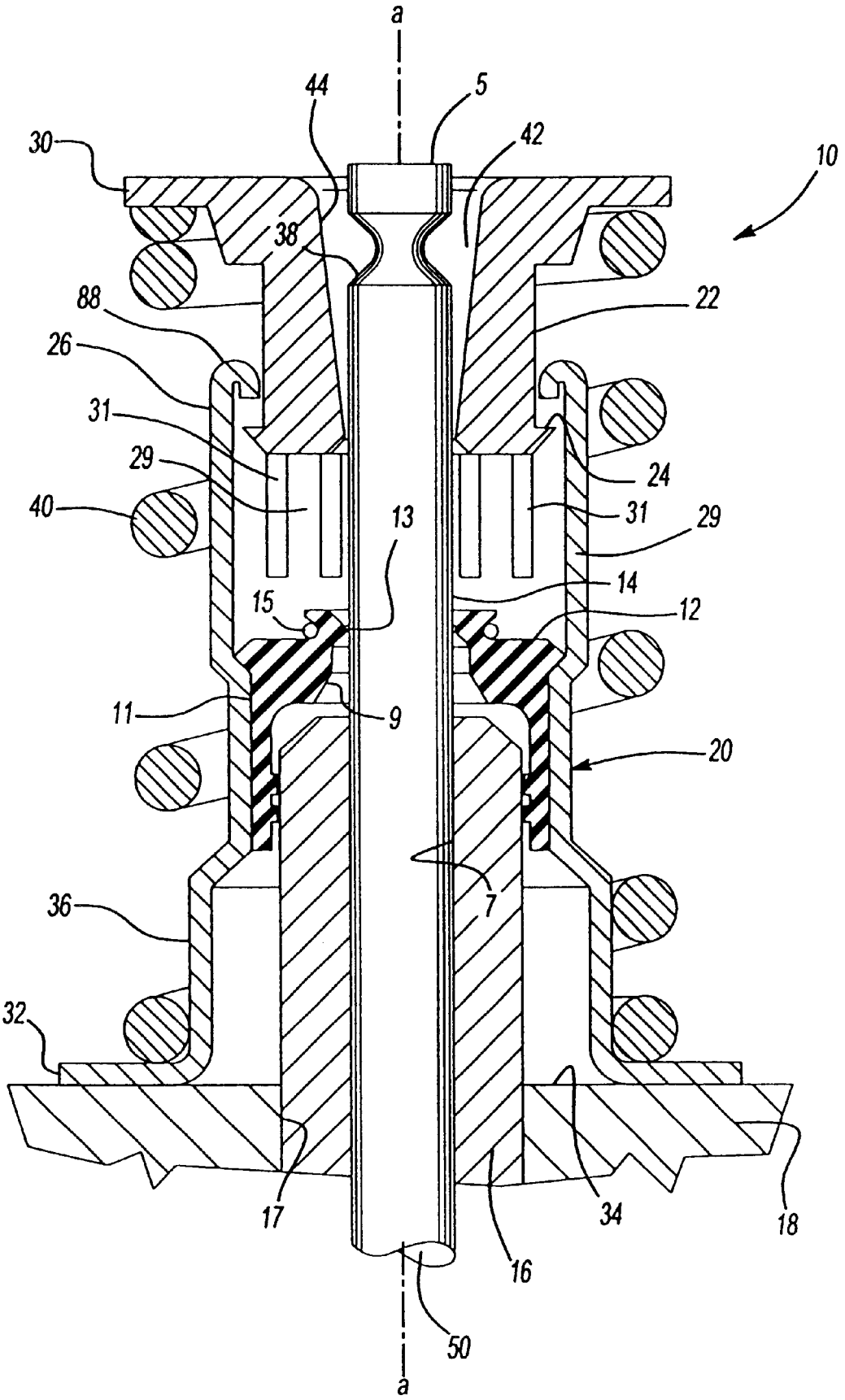
a
44
5
42
30
10
38
88
22
26
31
29
24
40
13
31
29
14
15
12
11
9
20
7
36
32
17
34
18
16
50
a

VALVE SEAL ASSEMBLY MODULE WITH SPRING AND RETAINERS

BACKGROUND OF THE INVENTION

1. Field of Invention

The present invention relates to valve stem seal assemblies for use in internal combustion engines, and more particularly to the design of modular seal assemblies incorporating specially designed cylindrical retainers.

2. Description of the Prior Art

Those skilled in the art will appreciate the manner in which intake and exhaust valves are employed in cylinder heads of internal combustion engines. Such valves, supported for reciprocal motion within valve guides, include integral elongated stems extending away from the engine cylinder heads, the ends of the stems typically interacting with rotating overhead cams for cyclic or repeated opening and closure of the valves against the force of valve return springs during the combustion cycle. Obviously, in order to permit unobstructed reciprocal movement of the stem in the guide, some mechanical clearance must exist between the valve guide and the moving stem. A plurality of valve stems thus move reciprocally to and from the cylinder head, each within its individual guide, and so-called valve stem seal assemblies are used to seal against leakage of oil through a mechanical clearance path between each annular engine valve guide and its associated valve stem.

As is well known, the intake port of a combustion chamber is opened and closed by the reciprocating motion of at least one intake valve, which in turn is driven by the rotary motion of a cam, the latter being affixed to and rotatable with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of similar construction and both include stems integrally affixed to the valves.

In the typical engine, a valve stem seal assembly is fitted over or atop each valve guide, wherein each seal assembly has a retainer frictionally mounted to an associated valve guide, or is alternately retained in place via cooperation of a return spring and a retainer flange, to assure securement of the assembly within the engine. Each valve stem seal assembly normally has two primary parts; 1) an elastomeric oil seal to control leakage of oil between the valve stem and guide as noted, and 2) a structural cylindrical part called a retainer mounted atop of the valve guide to hold the oil seal in place. In many cases, the retainer also has a so-called bottom flange that extends circumferentially about the bottom of the valve guide for support of the retainer against the cylinder head deck. Those skilled in the art will appreciate that the noted valve return springs bear against the bottom flange.

Much progress has been achieved in the art of valve stem seal design and construction. However, installation remains problematic for traditional valve stem seal assemblies. For example, the number of parts associated with a given valve stem seal assembly has typically been at least the two described: 1) the seal, and 2) the retainer. However, the typical installation of a valve stem seal includes the assembly of third and fourth parts, called a spring and spring retainer, respectively. The handling and installation of a valve stem seal could be made considerably easier by consolidation of the described four parts.

The module of the present invention overcomes handling and installation difficulties, and thus significantly facilitates valve stem seal assembly.

SUMMARY OF THE INVENTION

The present invention provides a four-piece valve stem seal assembly module adapted for installation atop of a valve guide of an internal combustion engine. A plurality of such modules is contemplated for use in an engine, each module designed for insertion over each engine valve guide. Each module is adapted for continuously and sealingly engaging an associated reciprocally movable valve stem. The seal body incorporates an interior circumferential aperture containing at least one radially inwardly directed, resilient, sealing lip adapted to engage the stem to minimize escape of oil lubricant from the engine along a path between the valve guide and the reciprocally movable valve stem. A seal retainer circumferentially and frictionally contains the seal, wherein the seal retainer is defined by a rigid elongate cylindrical body having a longitudinal axis and a circumferentially extending annular flange at its lower end. At its upper end, the seal retainer has at least one radially inwardly extending boss. The module further includes an annular rigid spring retainer including a lower extremity having at least one radially outwardly extending second boss adapted to interlockingly engage the first boss of the seal retainer in a preassembly mode.

Finally, the spring retainer includes a radially outwardly extending flange at its upper extremity wherein a valve return spring extends longitudinally between and engages the spring retainer flange and the seal retainer flange respectively. The force of the spring is effective to produce resilient engagement between the first and second bosses prior to assembly, whereby the spring retainer and the seal retainer are telescopingly interconnected within the module to facilitate installation thereof.

BRIEF DESCRIPTION OF THE DRAWING

The drawing is a cross-sectional view of one preferred embodiment of the present invention.

DETAILED DESCRIPTION OF ONE PREFERRED EMBODIMENT

Referring to the drawing, a valve stem seal assembly module 10 includes a resilient seal 12 adapted to sealingly engage an elongate valve stem 14. The valve stem 14 is supported for reciprocal movement within an annular valve guide 16, which fixedly extends longitudinally (or upwardly, as shown) through an aperture 17 of a cylinder head deck 18. For this purpose, the seal 12 is supported within a rigid cylindrical seal retainer 20 formed of metal in the preferred embodiment described and shown herein. The resilient body of the seal 12 is generally annular in shape, preferably formed of an elastomeric material, and includes interior and exterior surfaces 9 and 11, respectively. Within its interior surface 9, the seal 12 includes a circumferentially extending sealing lip 13 adapted to engage the exterior circumferential surface of the stem 14 for limiting and or otherwise controlling movement of crankcase oil along a mechanical clearance path 7 between the stem 14 and the valve guide 16, for undesirable escape of oil into the combustion chamber, as will be appreciated by those skilled in the art. The seal 12 is frictionally and circumferentially supported within the seal retainer 20, which has a shape adapted to matingly register with the exterior surface 11 of the seal. To enhance sealing effectiveness, a garter spring 15 encircles the exterior surface 11 to impart a radial compression force against the lip 13, and ultimately against the moving valve stem 14.

The module 10 further includes a spring retainer 22 that is adapted to be interlockingly interconnected in telescoping fashion with the seal retainer 20. Thus an annular bottom flange or boss 24 of the spring retainer 22 is adapted to telescopingly engage an upper end 26 of the seal retainer 20.

In its preferred form, the upper end 26 of the seal retainer 20 is slotted to provide longitudinally extending fingers 29. The slotted fingers are resilient, and can be dislodged radially outwardly during assembly to provide for insertion of the boss 24 of the spring retainer 22. In addition, vertical slots 31 between the fingers 29 are effective to admit splash and spray oil for assuring that at least a required minimum amount of oil may reach the reciprocating shaft during engine start-up, for reasons apparent to those skilled in the art.

Each of the upper ends 26 of the fingers 29 terminate in downwardly curved or goose-necked shaped portions collectively defining an inverted second boss 28. The extremities of the portions make the actual contact with the boss 24 of the spring retainer 22, as depicted. The retainer 22 includes an upper spring flange 30, while the bottom or lower end 36 of the seal retainer 20 contains a bottom spring flange 32 that bears on the top surface 34 of the cylinder head deck 18. Juxtaposed between flanges 30 and 32 is an externally disposed coil spring 40 sized to force the two flanges apart during the operation of the internal combustion engine (not shown). Thus, the spring 40 is effective to fully close a valve (exhaust, for example, not shown) connected to the bottom 50 of the valve stem 14, against the applied cyclic force of a cam which bears against the top 5 of the valve stem 14.

It will thus be appreciated that closure of the valve occurs at a position of maximum acceptable extension of the spring 40, or when the flanges 30 and 32 are at their greatest distance apart during the movement cycle of the valve, and hence of the valve stem 14. It will also be appreciated that among the parts of the module 10, only the spring 40, the spring retainer 22 and the valve stem 14 move during the engine cycle. Thus, the valve stem 14 which moves reciprocally along the vertical axis "a—a", is rigidly connected at its upper portion 38 to the spring retainer 22 by a pair of so-called keepers or metal connectors (not shown) mechanically wedged into the space 42 between the internal diameter 44 of the spring retainer 22 and the upper portion 38 of the stem 14.

It will further be appreciated by those skilled in the art that upon installation, the engagement or contact between bosses 24 and 28 will be broken, to the extent that the upper extremity of movement of the valve stem 14 is designed to be limited by valve closure as opposed to engagement of the latter bosses. Thus, upon installation a gap (not shown) will be present between the bosses at the upper limit of movement of the coupled valve stem 14 and spring retainer 22. Finally, upon disassembly of the module from valve stem 14 and valve guide 16, the bosses 24 and 28 will once again be urged together by the force of the spring 40, depending upon the dimensional tolerances of the particular application. Thus the module also facilitates the handling of the various valve stem seal and spring retainer parts by retaining all parts together during disassembly as well as during assembly.

Although the described embodiments of this invention contemplate that both retainers 20 and 22 are formed of metal, other materials may be suitable for one or the other, depending upon engine size and harshness of the particular engine environment. For example, some glass-filled nylons or other plastics may be suitable in some environments. Obviously, in such cases either or both retainers might suitably be formed of plastic materials.

It is to be understood that the above description is intended to be illustrative, and not limiting. Many embodiments will be apparent to those of skill in the art upon reading the above description. The scope of the invention should be determined, however, not with reference to the above description, but with reference to the appended claims and the full scope of equivalents to which the claims are entitled by law.

What is claimed is:

1. A valve stem seal assembly module adapted for installation atop of a valve guide of an internal combustion engine for sealingly engaging a valve stem reciprocally movable through the guide, said module comprising a resilient annular valve stem seal adapted to engage the valve stem and further comprising a seal retainer for circumferentially and frictionally containing said seal, said seal retainer defining a rigid elongate cylindrical body having a longitudinal axis and a circumferentially extending annular flange at its lower end and at least one radially inwardly extending first boss at its upper end, said module further comprising an annular rigid spring retainer including a lower extremity having at least one radially outwardly extending second boss adapted for interlockingly engaging said first boss of said seal retainer in a pre-assembly mode, said spring retainer comprising a radially outwardly extending flange at its upper extremity; said module further comprising an elongate valve return spring having longitudinal extremities engaging said spring retainer flange and said seal retainer flange, respectively, whereby engaging contact between said first and second bosses of said spring retainer and said seal retainer is established in said pre-assembly mode.

2. The valve stem seal assembly module of claim 1 wherein said seal retainer extends axially beyond said resilient seal to interlockingly engage said spring retainer, wherein said seal retainer and said spring retainer are telescopingly coupled together.

3. The valve stem seal assembly module of claim 2 wherein said return spring defines the radially outermost circumferential extremity of said module, and wherein said spring retainer boss comprises an annular flange, and said seal retainer boss comprises a plurality of inverted goose-necked ends adapted to engage said flange.

4. The valve stem seal assembly module of claim 3 wherein said seal retainer comprises a plurality of circumferentially disposed vertically oriented fingers.

5. The valve stem seal assembly module of claim 4 wherein said fingers are adapted to be flared for installation of said spring retainer boss into said upper end of said seal retainer.

6. The valve stem seal assembly module of claim 4 wherein said vertically oriented fingers define slots in spaces between said fingers for admission of splash and spray oil to said seal and said reciprocally movable stem.

7. The valve stem seal assembly module of claim 6 further comprising an annular lip for sealingly engaging said valve stem, wherein said lip is radially compressed against said stem via a garter spring circumferentially engaging the exterior of said seal.

8. The valve stem seal assembly module of claim 7 wherein upon installation of said module, said first and second bosses are spaced apart to form a gap.

9. The valve stem seal assembly module of claim 8 wherein when installed said valve return spring has a limited spring extension defined by closure of a valve at the bottom of the valve stem.

10. The valve stem assembly module of claim 9 wherein said seal retainer comprises a plastic material.

* * * * *